United States Patent [19]

Tsutsumi et al.

[11] 4,452,200

[45] Jun. 5, 1984

[54] CONTROL DEVICE FOR INTERNAL COMBUSTION ENGINE

[75] Inventors: Kazumichi Tsutsumi, Hyogo; Masahiko Matsuura, Hiroshima, both of Japan

[73] Assignees: Mitsubishi Denki Kabushiki Kaisha, Tokyo; Toyo Kogyo Co., Ltd., Hiroshima, both of Japan

[21] Appl. No.: 422,914

[22] Filed: Sep. 24, 1982

[30] Foreign Application Priority Data

Sep. 25, 1981 [JP] Japan ..... 56-152784
Sep. 25, 1981 [JP] Japan ..... 56-152785

[51] Int. Cl.[3] ..... F02D 11/10
[52] U.S. Cl. ..... 123/339
[58] Field of Search ..... 123/339, 361, 352, 340, 123/399

[56] References Cited

U.S. PATENT DOCUMENTS

| | | | |
|---|---|---|---|
| 4,120,373 | 10/1978 | Fleischer | 123/399 |
| 4,245,599 | 1/1981 | Des Lauriers | 123/361 |
| 4,291,656 | 9/1981 | Miyagi | 123/339 |
| 4,305,360 | 12/1981 | Meyer | 123/340 |
| 4,319,658 | 3/1982 | Collonia | 123/361 |
| 4,365,601 | 12/1982 | Yamazoe | 123/339 |

*Primary Examiner*—Ronald B. Cox
*Attorney, Agent, or Firm*—Sughrue, Mion, Zinn, Macpeak & Seas

[57] ABSTRACT

A throttle opening control device includes a driver for controlling the opening of the throttle during idling and a judgment circuit or an idle switch for determining an idling condition and means for halting driver operation during non-idling intervals. In one embodiment, a sensor detects the throttle opening and supplies the same to a throttle driver by way of a difference circuit which forms a deviation value between the output of the sensor and that of an arithmetic unit whose operation is suspended during non-idling periods.

8 Claims, 10 Drawing Figures

CONTROL DEVICE FOR INTERNAL COMBUSTION ENGINE

BACKGROUND OF THE INVENTION

This invention relates to a throttle opening control device for an internal combustion engine for controlling the throttle opening thereof during idle running.

FIG. 1 is a block diagram showing a control device of a conventional type. In FIG. 1, there are arranged a throttle valve 100 of an internal combustion engine, a throttle stopper 200 for controlling the throttle valve 100 during idle running of the internal combustion engine, an opening sensor 300 for detecting the opening of said throttle valve 100, a driver 400 for controlling the throttle valve 100 through the throttle stopper 200 according to the deviation c between the actual opening a and a predetermined opening b, and an idle switch 500 which detects whether the throttle valve lies at the idle position and, according to the result, governs the action and stop of the driver 400. FIG. 2 is a model showing the constitution of said throttle stopper 200. In FIG. 2, there are arranged the throttle valve 100, its throttle lever 101, the throttle stopper 200, and its stopper lever 201. The throttle stopper 200 opens and closes the throttle value 100 through the throttle lever 101 by moving the stopper lever 201 up and down. The idle switch 500 is incorporated in the throttle stopper 200, and whether the throttle valve 100 is at the idle position is detected by examining the contact condition of the throttle lever 101 with the stopper lever 201. In the throttle opening control device having such a construction, if the actual opening a becomes smaller than the desired opening b for any reason during idling of the engine, a plus opening deviation c occurs, and, as a result, the driver 400 opens the throttle valve 100 through the throttle stopper 200 so that the acual opening a is controlled to reach the desired opening b. If the actual opening a becomes larger, it is similarly controlled. If the throttle valve 100 is opened by, for example, an accelerating pedal to accelerate the internal combustion engine, it becomes impossible to control the throttle valve using the throttle stopper 200, but, in this case, the driver 400 stops its operation by the action of the idle switch 500, the controlling position level a of the throttle stopper 200 being held. When the accelerating pedal is released and idling starts, the driver 400 starts its operation by the action of the idle switch 500, and control of the opening as described above is performed. FIG. 3 is a timing chart of the operations mentioned above: t1 indicates the point when the throttle valve 100 is opened for acceleration, and t2 the point when the throttle 100 is returned and the idle condition is restored; e represents the control signal from the idle switch 500 to the driver 400, and the operation of the driver 400 is stopped between the points t1 and t2.

In the conventional device as described, whether the internal combustion engine is in an idling condition or not is judged by means of the idle switch 500. Generally, this type of switch requires high reliability, durability, etc., and is expensive.

This invention also relates to an idling speed control device for controlling the idling speed of an internal combustion engine. FIG. 1*a* is a block diagram showing an example of a conventional idling speed control device for an internal combustion engine. In FIG. 1*a*, there are arranged an internal combustion engine 100', a throttle valve 101' for the internal combustion engine 100', a throttle stopper 200' controlling the throttle valve 101' during idle running of the engine 100', an engine speed sensor 300' for detecting the speed of the internal combustion engine 100', and an arithmetic unit 400' for integrating the deviation c between an actual speed a of the internal combustion engine 100' as detected by the engine speed sensor 300' and a predetermined desired speed b. A position sensor 500' detects the operating position of the throttle stopper 200', and a driver 600' operates the throttle valve 101' through the throttle stopper 200' according to the deviation f between a desired operating position e or the output of the arithmetic unit 400' and an actual operating position d detected by the position sensor 500'. An idle switch 700' governs the action and stop of operation of the arithmetic unit 400' according to the relation between the opening of the throttle valve 100' and the operating position of the throttle stopper 200'.

In the construction described above, the arithmetic unit operates during idle running of the internal combustion engine 100' by the action of the idle switch 700'.

Now, for example, if the actual speed a becomes lower than the desired speed b due to any reason, the arithmetic unit 400' integrates the resultant deviation of the speed c, and the desired operating position is increased. As a result, the deviation f increases, so that the driver 600' opens the throttle valve 101' through the throttle stopper 200'. The actual speed a is increased thereby until it reaches the desired speed b. FIG. 2*a* is a timing chart showing the above operations.

Contrarily, if the actual speed a becomes higher than the desired speed b, the actual speed a is brought down to the desired speed b through similar actions.

When the internal combustion engine 100' is not idling, the arithmetic unit 400' stops its operation, and the desired operating position e is held, the throttle stopper being controlled to this position. In the conventional device described above, the position sensor 500' is used to detect the operation position of the throttle stopper 200', whereas many internal combustion engines are generally equipped with an opening sensor detecting the throttle opening for purposes other than the control of the idling speed. This opening sensor performs an action equivalent to that of the position sensor 500' during idle running of internal combustion engine.

SUMMARY OF THE INVENTION

This invention is intended to remove the above problems pertaining to the conventional device, and has an object of providing an inexpensive throttle opening control device for an internal combustion engine, which, in one embodiment, requires no idle switch.

The present invention has been made noting the fact that the throttle opening sensor performs an action equivalent to that of the position sensor, and a further object of this invention is to provide an inexpensive idling speed control device for an internal combustion engine which requires no position sensor, by using the opening sensor to detect the operating position of the throttle stopper.

DETAILED DESCRIPTION OF THE PREFERRED EMBODIMENTS

Figure 1:
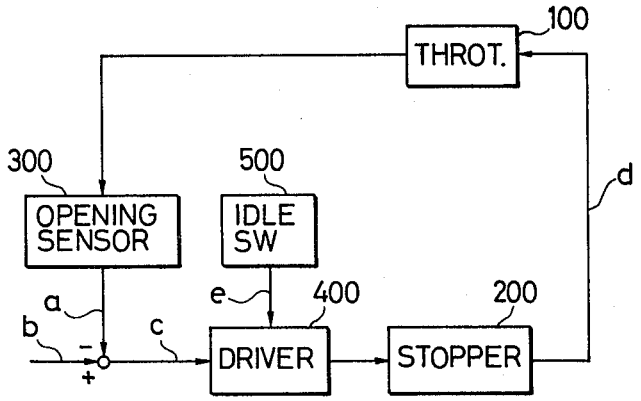
FIG. 1 is a block diagram showing a conventional throttle opening control device for an internal combustion engine.
Figure 4:
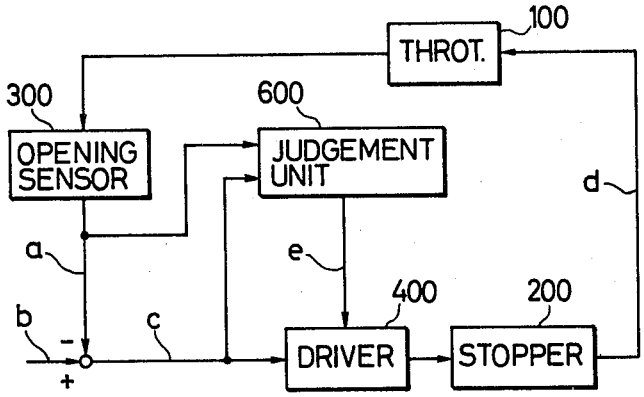
FIG. 4 is a block diagram showing a throttle opening control device according to this invention.

An embodiment of the opening control device according to this invention will now be described with reference to the accompanying drawings. FIG. 4 is a block diagram showing the constitution of an embodiment of this invention. In FIGS. 1 and 4, numerals from 100 to 400 denote same or equivalent parts, respectively.

A judgment unit 600 having a function similar to that of the idle switch 500 detects whether the throttle valve 100 is at the idle position or not by referring to the actual opening a and the deviation c, and controls the driver 400 according to the result.

Figure 4A:
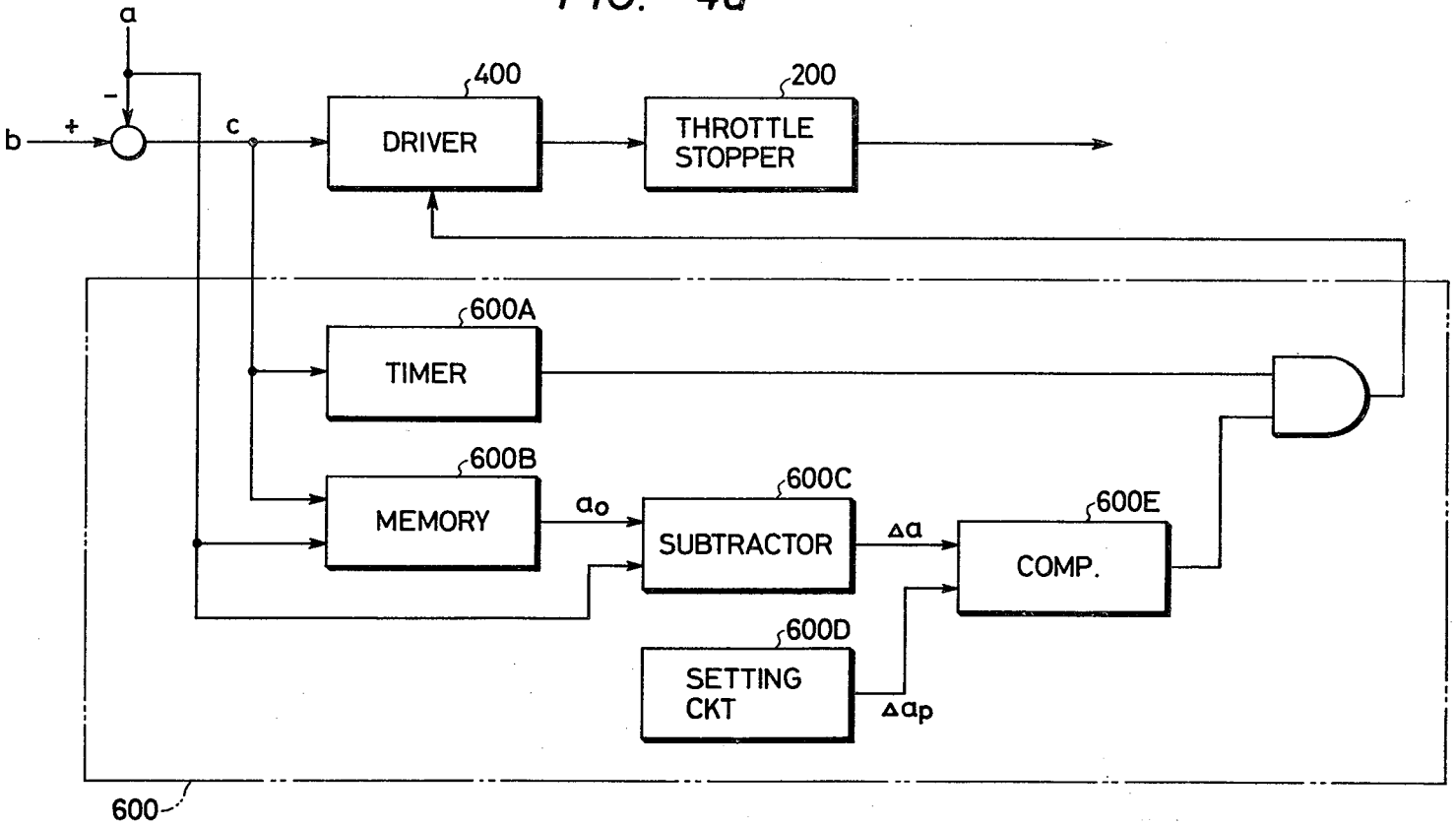
FIG. 4*a* is a block diagram showing the details of a judgment circuit of FIG. 4.

The details of the decision circuit 600 are shown in FIG. 4*a*.

When the signal c is shifted to negative values, the output of a timer 600A is inverted from "0" to "1" after a predetermined time. On the other hand, when c is positive, the timer 600A is reset. The throttle opening degree a at the time when c was shifted to negative values is stored in a memory 600B.

In a subtractor 600C, a calculation $(a-a_O)=\Delta a$ is carried out, when $a_O$ is the actual throttle opening degree, and a circuit 600D operates to set a value $\Delta a_p$ for detecting the non-idling condition.

The comparator 600E operates to compare $\Delta a$ with with $\Delta a_p$. When $\Delta a > \Delta a_p$, the comparator 600E produces an output of 1 whereas it produces a low level output when $\Delta a \leqq \Delta a_p$. During the non-idling condition, both input signals to an AND gate 600F are thus equal to "1" and the AND gate 600F produces an output signal to stop the operation of driver 400. The operation of the throttle opening control device according to this invention so constructed will now be described. If the throttle valve 100 is opened by, for example, the accelerating pedal, the actual opening a increases, and the deviation c continues to take a minus value. If the deviation c continues to take a minus value for a predetermined period of time and the actual opening a increases by a predetermined value, the judgment unit 600 detects this fact, and stops the operation of driver 400, with the controlling position d of the throttle stopper 200 being held.

When the accelerating pedal is released and the throttle valve 100 returns to the idle position, the deviation c disappears. The judgment unit 600 detects this fact, and allows the driver 400 to start its operation controlling the opening.

Figure 5:
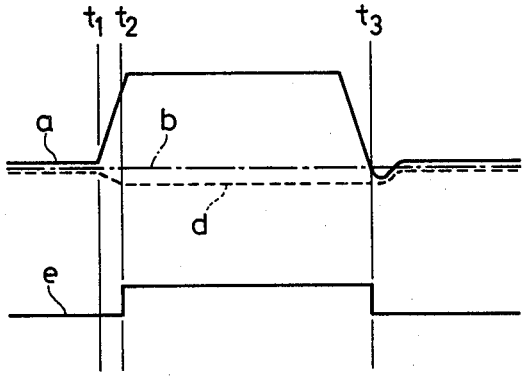
FIG. 5 is a timing chart showing the operation of the throttle opening control device according to the invention.

FIG. 5 is a timing chart for the operations mentioned above: t1 indicates the point when the throttle valve 100 is opened; t3, the point when the throttle valve 100 returns to the idle position; and $t_2$, the point when the acceleration is detected by the judgment unit 600 and the operation of the driver 400 is stopped.

As described above, the judgment unit 600 has a function equal to that of the idle switch 500 of the conventional device.

It is obvious from the aforementioned description that the throttle opening control device according to this invention does not necessitate an expensive idle switch as used in the conventional devices, resulting in a reduction in costs, since, in this device, the judgment unit judges whether the throttle valve lies at the idle position referring to the actual opening a and the deviation c.

Figure 1A:
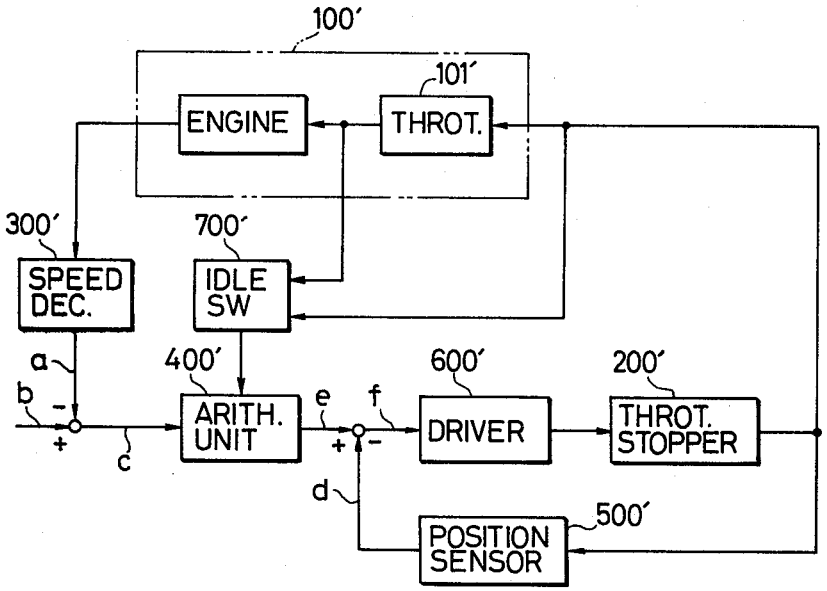
FIG. 1*a* is a block diagram showing the constitution of a conventional idling speed control device for an internal combustion engine.
Figure 2:
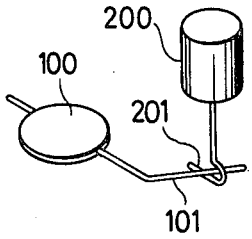
FIG. 2 is a model showing the constitution of the throttle stopper of the throttle opening control device shown in FIG. 1.
Figure 2A:
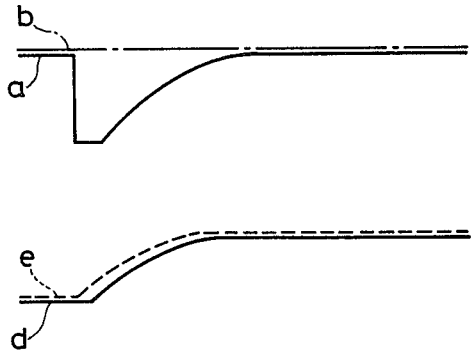
FIG. 2*a* is a timing chart showing the operation of the idling speed control device shown in FIG. 1*a*.
Figure 3:
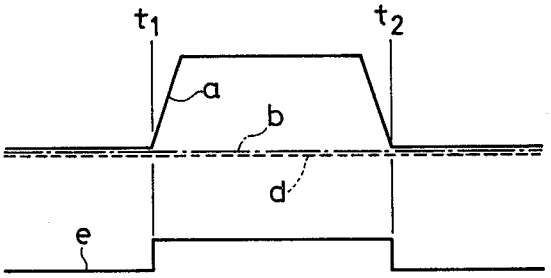
FIG. 3 is a timing chart showing the operation of the throttle opening control device shown in FIG. 1.
Figure 6:
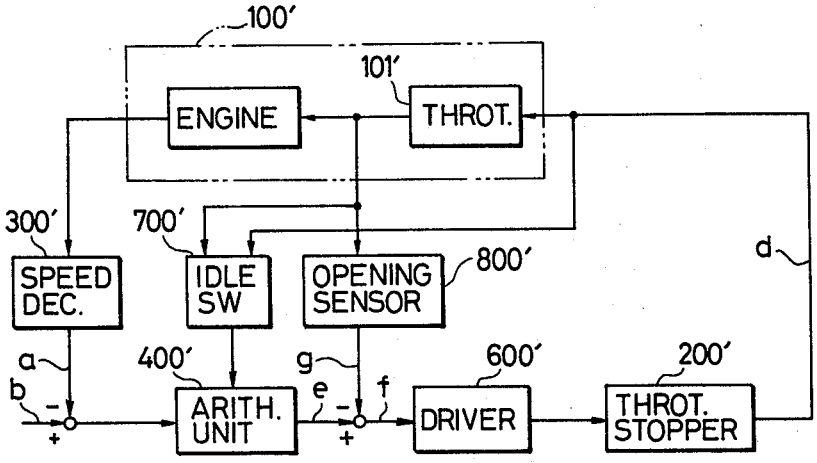
FIG. 6 is a block diagram showing an embodiment of the idling speed control device according to this invention.

An embodiment of another idling control device according to this invention will now be described with reference to the accompanying drawings. FIG. 6 is a block diagram showing the constitution of this embodiment. In FIG. 6, numeral 800′ denotes an opening sensor for detecting the opening of the throttle valve 101′. The same numerals in FIGS. 1*a* and 6 denote the same or equivalent parts, respectively. The operation of the idling speed control device having this construction will now be described. During idle running of the internal combustion engine, the throttle valve 101′ is operated by the throttle stopper 200′ and the throttle opening g detected by the opening sensor 800′ corresponds to the actual operating position d in the conventional device mentioned above. Accordingly, the action of the device shown in FIG. 6 during idle running is the same as that of the conventional device as shown in FIG. 1*a*.

Figure 7:
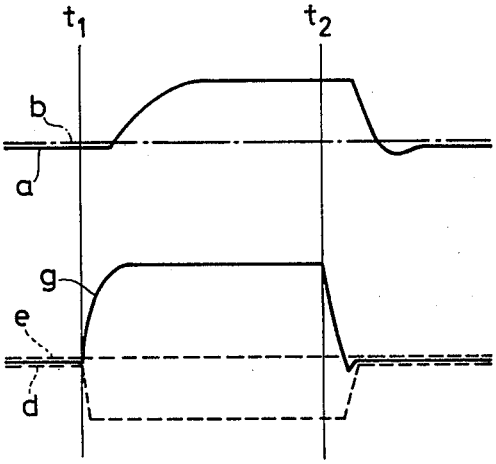
FIG. 7 is a timing chart showing the operation of the idling speed control device shown in FIG. 6.

When the internal combustion engine 100′ is accelerated and not idling, the operation of the arithmetic unit 400′ is stopped by the action of the idle switch 700′, as is the case in the conventional device, and the desired operating position e is held as shown in the time chart of FIG. 7 (wherein t1 denotes the point when acceleration is started, and t2 the point when returning to the idling condition). The arithmetic unit 400′ may take the form of a control circuit and an integrating circuit as disclosed, for example, in copending U.S. application Ser. No. 423,333 commonly assigned.

At this time, since the throttle valve 101′ is opened, the throttle opening indicates a value larger than the desired operating position e, and as a result, the operating position d of the throttle stopper 200′ reaches the minimum value that it can take by the action of the driver 600′. When the internal combustion engine returns to the idling condition, the throttle opening g assumes the operating position d of the throttle stopper 200′ as described for the idle running period, and the throttle stopper 200′ is controlled to the desired operating position e. Then, the arithmetic unit 400′ starts operation by the action of the idle switch 700′ to control the idling speed. As described above, in the idling speed control device according to this invention, the operation position of the throttle stopper is detected by the opening sensor, so that no position sensor is necessitated, resulting in a reduction in manufacturing costs.

What is claimed is:

1. A throttle opening control device for an internal combustion engine, comprising: throttle stopper means for controlling a control valve of an internal combustion engine during idle running, sensor means for detecting the opening of said valve, drive means for controlling the opening of said valve through said throttle stopper according to a deviation between an actual opening detected by said sensor means and a predetermined desired opening, and judgment means for suspending operation of said driver in a non-idling state of said engine, according to an output of said sensor indicative of actual opening of said control valve and to said deviation.

2. An idling speed control device for an internal combustion engine, comprising: throttle stopper means for controlling air intake control means of an internal combustion engine during idle running, sensor means for detecting the opening of said air intake control means, arithmetic means for generating valves corresponding to a deviation between an actual speed of said internal combustion engine and a predetermined desired speed, driver means for controlling said air intake control means through said throttle stopper means according to the arithmetic means and an actual opening detected by said sensor means, and an idle switch for suspending operation of said arithmetic means in a non-idling state of said engine according to an output of said idle switch indicative of said non-idling state of said internal combustion engine, said idling switch operating in response to an output of said throttle stopper and a position of said intake control means.

3. A control device as claimed in claim 1, said control valve comprising a throttle valve of said engine.

4. A control device as claimed in claim 1, said judgment means comprising timer means receiving said deviation, memory means for storing an actual opening value when said deviation goes negative, and means for calculating a difference between said stored value and subsequent actual opening values.

5. A control device as claimed in claim 4, said difference being compared with a reference non-idling value, and a result of said comparison being applied to output AND means.

6. A control device as claimed in claim 5, an output of said timer being applied to said output AND means, to thereby detect a non-idling condition, an output of said AND means comprising a stop signal for said driver.

7. A control device as claimed in claim 2, wherein said air intake control means comprises a throttle valve of said engine.

8. A control device as claimed in claim 2, including difference means for generating a deviation value between an output of said arithmetic means and said actual opening, to form an input for said driver means.

* * * * *